United States Patent [19]

Zimmer

[11] 4,030,411

[45] June 21, 1977

[54] ROTARY-SCREEN PRINTING MACHINE

[76] Inventor: Peter Zimmer, Untere Sparchen 54, A6330 Kufstein, Austria

[22] Filed: June 20, 1975

[21] Appl. No.: 588,592

[30] Foreign Application Priority Data

July 3, 1974 Austria ..... 5500/74

[52] U.S. Cl. ..... 101/126; 101/118

[51] Int. Cl.[2] ..... B41F 15/24

[58] Field of Search ..... 101/115, 116, 118, 126

[56] References Cited

UNITED STATES PATENTS

| | | | |
|---|---|---|---|
| 1,821,302 | 9/1931 | Gorner | 101/126 |
| 2,870,703 | 1/1959 | Balmer | 101/126 |
| 2,968,239 | 1/1961 | Zumbehl | 101/126 X |
| 3,291,044 | 12/1966 | Van der Winden | 101/118 |
| 3,585,930 | 6/1971 | Bohm | 101/127.1 X |
| 3,811,378 | 5/1974 | Bohm | 101/119 X |
| 3,859,916 | 1/1975 | Zimmer | 101/120 X |

FOREIGN PATENTS OR APPLICATIONS

| | | | |
|---|---|---|---|
| 2,304,289 | 9/1973 | Germany | 101/128.1 |

*Primary Examiner*—Edgar S. Burr
*Assistant Examiner*—R. E. Suter
*Attorney, Agent, or Firm*—Ernest G. Montague; Karl F. Ross; Herbert Dubno

[57] ABSTRACT

A group of cylindrical printing screens, rotatable about parallel axes, are journaled on a machine frame and carry coaxial gears in mesh with driving pinions on the frame. A bed, designed to support a substrate to be imprinted, is supported underneath each screen on the frame through the intermediary of elevation-adjusting wedges interlinked by a control rod. The sceens can be axially tensioned by mounting units, slidable on axially extending guide rods, which carry spring-loaded thrust bearings acting in an axially outward direction upon their coaxial gears.

4 Claims, 7 Drawing Figures

ROTARY-SCREEN PRINTING MACHINE

FIELD OF THE INVENTION

My present invention relates to a rotary-screen imprinting machine for printing continuous substrates of considerable thickness and being of a relatively soft structure, preferably carpets, the substrate being guided continuously between the printing screen and a bed.

BACKGROUND OF THE INVENTION

With conventional printing methods having become the printing screen is forced with adjustable pressure onto the surface of the substrate to be imprinted. However, the printing screens and the bed are in a fixed relation to each other, i.e., the distance between the two elements is constant. In case the thickness of the substrate changes, it is necessary to readjust this distance. Systems are known in which the printing screen is so mounted as to rest almost with no pressure on the substrate to be imprinted.

When printing relatively thick, i.e. highly piled substrates, very large frictional forces are exerted by the substrate onto the printing screen on account of the compression of the substrate. These forces are generated by bending the pile threads which are rather stiff and extend vertically in the most cases. These threads tend to become jammed in the perforations of the printing screen and, on being deflected against the direction of motion during the printing process, subject the screen wall to great stress.

OBJECTS OF THE INVENTION

An object of my present invention is to provide a structure avoiding these stresses.

Another object is to provide a screen printing machine which can easily be adapted to the thickness of the substrate to be printed.

SUMMARY OF THE INVENTION

In accordance with my present invention, a plurality of cylindrical printing screens rotatable about parallel axes, lying on a common level, are driven by pinions on the machine frame in mesh with gears that are rigid and coaxial with these screens. In order to maintain a constant depth of interengagement between these pinions and gears while accommodating substrates of different thickness, each screen overlies a bed whose distance from the common axial level of the screens is variable with the aid of elevation-adjusting means inserted between the bed and the machine frame for simultaneously displacing all beds in a vertical direction.

Although in principle the elevation-adjusting means could include a variety of devices such as spindles or hydraulic pistons, I prefer to use for this purpose a set of rollers on the undersides of the beds and a set of wedges bearing from below upon these rollers. The wedges are, advantageously, supported by stationary bases.

BRIEF DESCRIPTION OF THE DRAWING

The above and other features of my invention will now be described in detail with reference to the accompanying drawing in which.

SPECIFIC DESCRIPTION

Figure 1:
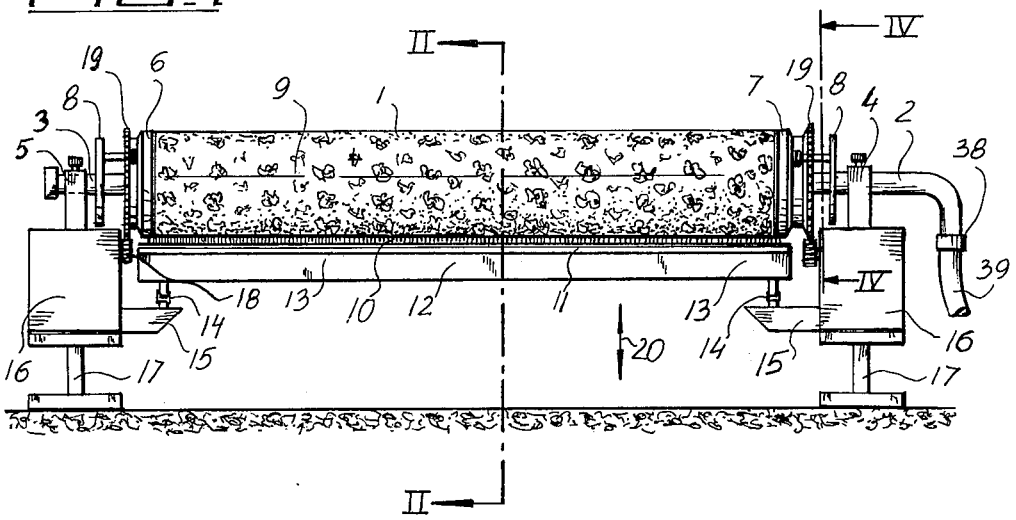
FIG. 1 is a side-elevational view of a screen printing machine incorporating the invention.

Reference is first made to FIG. 1 showing a cylindrical printing screen 1 with heads 6, 7 supported in non-illustrated journal bearings for rotation about a horizontal axis 9. At both ends of the printing screen 1 tensioning devices 8 are provided engaging the heads 6, 7. By these devices 8 the printing screen 1 is maintained in position and tensioned parallel to the horizontal axis 9. However, this tensioning is not necessary in each case; its purpose is mainly to stiffen the printing screen having relatively thin walls. Each head 6 or 7 is integral with a gear 19 engaged by a pinion 18 within a gear box 16 resting on the frame 17 of the machine. The pinions 18 are driven in the same direction and synchronously. By the engagement of the pinions 18 with the gears 19 of the heads 6, 7 the printing screen 1 is driven and the torque developed between the screen 1 and a substrate 10 to be imprinted lying beneath the screen 1, is absorbed.

A supply tube 2, disposed at one end of the screen, is connectd by a joint 38 to a pipe 39 which leads to a non-illustrated source of liquid dyestuff under pressure, e.g. as disclosed in my copending application Ser. No. 449,473, filed on Mar. 8, 1974 and now abandoned. At the other end of the screen a support tube 3 is provided. Instead of a single supply tube fed at one end as shown, I may use a pair of symmetrical tubes with closed confronting ends extending about half-way into the screen 1 from opposite sides and communicating separately with the fluid source.

FIG. 1 further shows bearing posts 4, 5 which rise from the boxes 16 to hold an applicator 25 (FIGS. 2 and 3) within the screen 1. An applicator housing 29, more fully illustrated in FIG. 3, extends axially within the screen 1. A distributing member 26 is slidably guided in the bottom of applicator housing 29 so as to come to rest on the inner screen surface at the nadir thereof. At spaced positions consoles 15 are attached to the gear boxes 16 and support the two ends 13 of a bed 12 by devices 14 enabling the vertical adjustment of the bed as indicated by a double arrow 20. The devices 14 will be described in detail with reference to FIG. 3. The bed 12 carries a supporting belt 11 entraining the substrate 10 to be imprinted.

Figure 2:
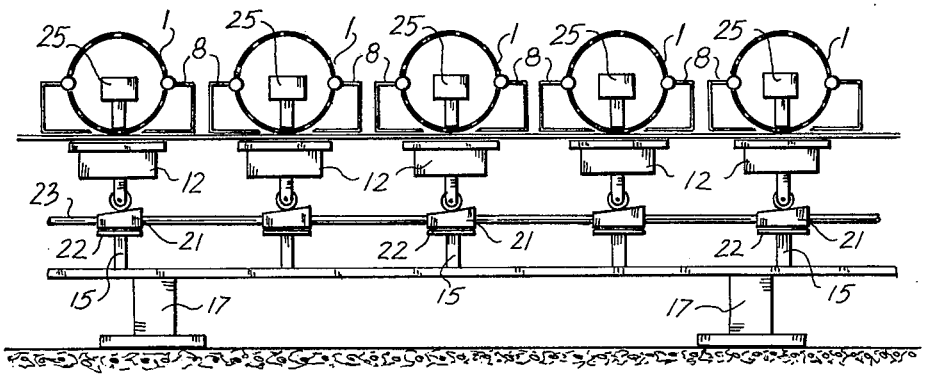
FIG. 2 is a cross-sectional view taken along the line II—II of FIG. 1, showing a series of printing screens.

As shown in FIG. 2, the printing machine comprises a plurality of printing screens 1 each having a tensioning device 8 and being provided in its interior with a dyestuff applicator 25 to be described in more detail with reference to FIG. 3. The bed 12 underlying each printing screen 1 is supported by a wedge 21 resting on a base 22 and on the consoles 15. By a horizontal shift of the wedge 21 the vertical position of the bed 12 relatively to the screen 1 can be changed. However, this adjustment of position has to be the same for all beds 12 and to this end all wedges 21 of the machine are interconnected by way of a rod 23. The rod 23 can be moved in accordance with an arrow 24, FIG. 3, so as to change the elevation of all the beds 12 in the same sense and to the same extent. The wedges 21 and their bases 22 form part of the elevation-adjusting devices 14 shown in FIG. 1.

The housing 29 of applicator 25 contains the printing liquid under superatmospheric pressure. As seen in FIG. 3, the opposite side walls 40 of the housing 29 terminate in inbent lower edges 41; the housing bottom is formed by flanges 42 of a pair of angle profiles 43 whose vertical webs 31 constitute guide elements for the hollow block constituting the distributing member 26. This block penetrates upwardly into the housing 29, through a gap formed between the transversely spaced profiles 43, and supports an elastomeric membrane 28 of natural rubber, for example, which is fastened to the top of member 26 by screws 49 and is marginally clamped between edges 41 and flanges 42 in a fluid-tight manner by screws 45. The block 26 is provided with a channel 46 for the descent of the printing liquid. Channel 46 is partly closed from below by two Teflon strips 32 defining between them a discharge slot 47 while facilitating relative sliding between member 26 and screen 1. The membrane 28 is a continuous foil having openings 460 registering with channel 46; its two halves form a pair of aprons, weighted down by the overlying liquid volume under pressure, which not only prevent leakage between flanges 31 and block 26 but also bias the Teflon strips 32 of member 26 into firm contact with the surface of screen 1 so as to prevent the liquid from escaping onto that screen surface instead of penetrating the pattern-forming perforations of the screen to imprint the underlying substrate 10.

Within the block 26 a shutter rod 27 is rotatably lodged, this rod having transverse bores 48 aligned with channel 46 when rod 27 is in its illustrated unblocking position. By a linkage and a servomotor (not shown) the rod 27 may be turned through 90° to stop the outflow of dyestuff as more fully described in my copending application Ser. No. 438,261 filed Jan. 31, 1974, now U.S. Pat. No. 3,949,667.

Figure 3:
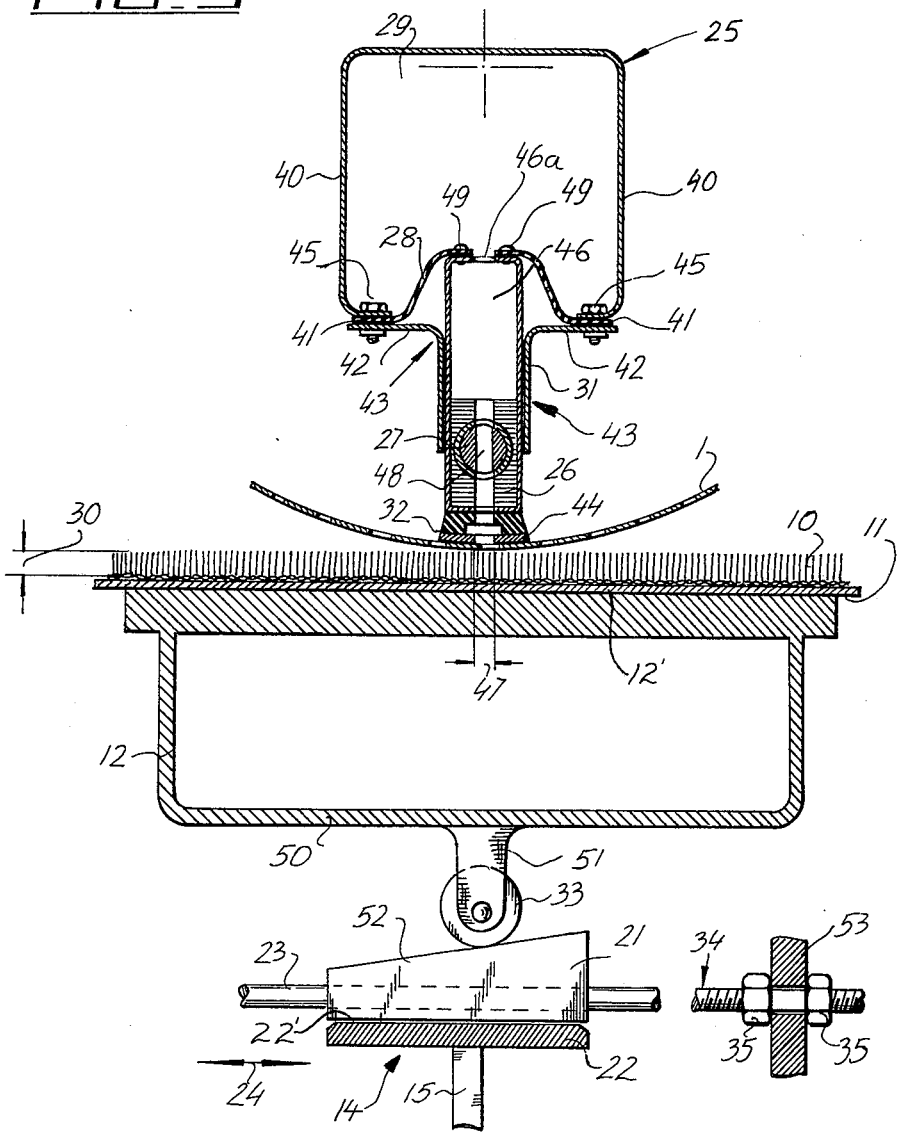
FIG. 3 is a fragmentary cross-sectional view of a single printing screen drawn to a somewhat larger scale.
Figure 4:
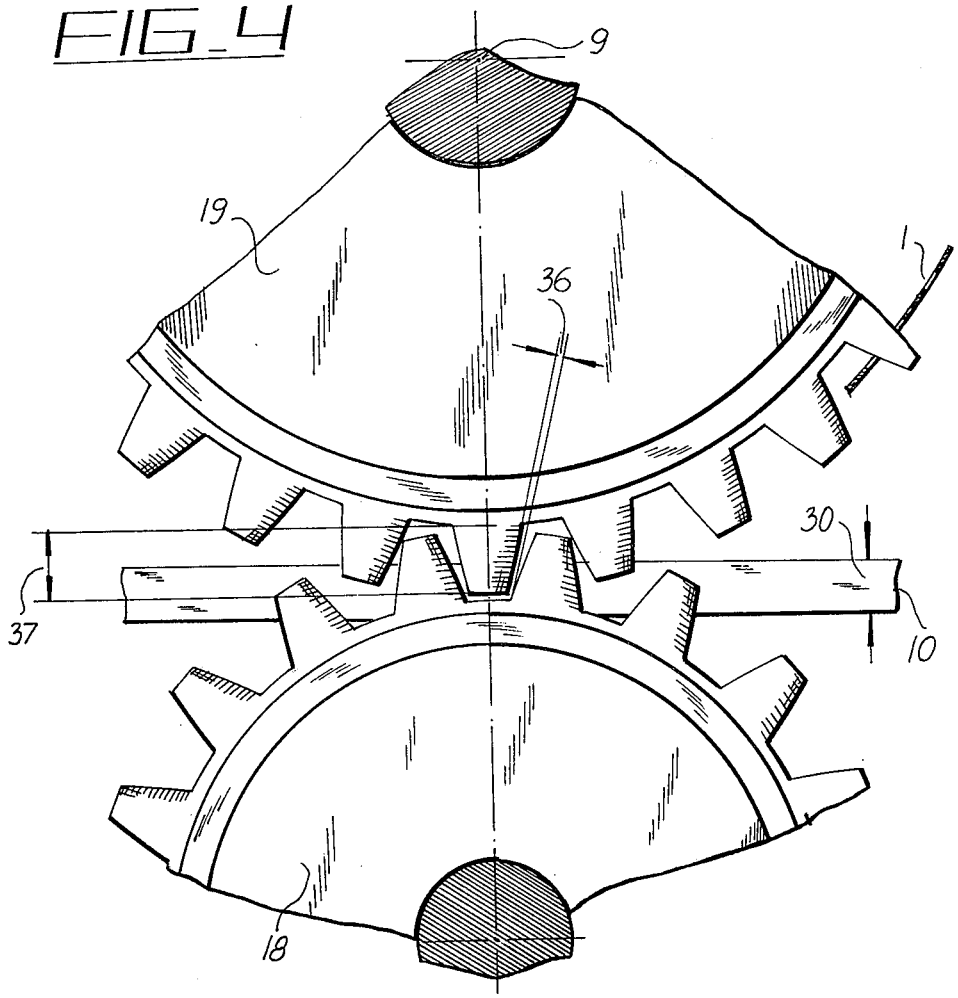
FIG. 4 is a detail view taken on the line IV—IV and drawn to a still larger scale.

I shall now describe, with reference to FIG. 3, details of my improved elevation-adjusting devices 14 which can be so operated that the printing screen 1 does not compress the substrate 10 but just touches the same at its surface. The lowermost portion 50 of the bed 12 is provided with lugs 51 carrying one or more rollers 33, resting on the sloping surface 52 of the associated wedge 21 which is transversed by and fixed to the rod 23. If the rod 23 is, for instance, moved to the right the bed 12 is lowered; if the rod 23 is moved to the left, the bed will be raised. Thus, the movement of wedge 21 can compensate for changes in the thickness 30 of substrate 10. The rod 23 can be locked in its selected position, for instance by a screw connection between a threaded extremity 34 and two nuts 35 which keep the rod in position with respect to a wall 53. By this adjustment the printing can be effected without compressing the substrate 10. The level chosen for the screen is kept constant. As further indicated in FIG. 3, each bed 12 has a flat horizontal surface 12′ supporting the substrate 10 by way of the belt 11. A similar but smaller upper surface 22′ of base 22, spacedly confronting the roller 33, serves as a support for the wedge 21. The driving mechanism for rotating the screen 1 comprises the pinions 18 and the gears 19 rigid with the screen. The engagement of two of these toothed wheels 18, 19 is shown in FIG. 4. It is absolutely necessary for a smooth and good function of the drive that there be a certain play or clearance 36 of the teeth between these two gears 18, 19. However, the clearance 36 should not be any larger than absolutely necessary in order to avoid major inaccuracies of the pattern. Moreover, especially if large stresses occur, it is necessary that the depth of interengagement of the two gears 18, 19 should vary only within narrow limits. This, precisely, is achieved by the vertical adjustability of the bed 12 in accordance with my invention. If the adjustment of the screen position relative to the bed, pursuant to the thickness of the substrate 10, were accomplished by a vertical translation of the screen 1, a fluctuation of the clearance 36 would be the immediate consequence, and would increase the risk of fracture as well as the risk of an inaccuracy of the pattern, especially when useing an intermittent printing method.

Figure 5:
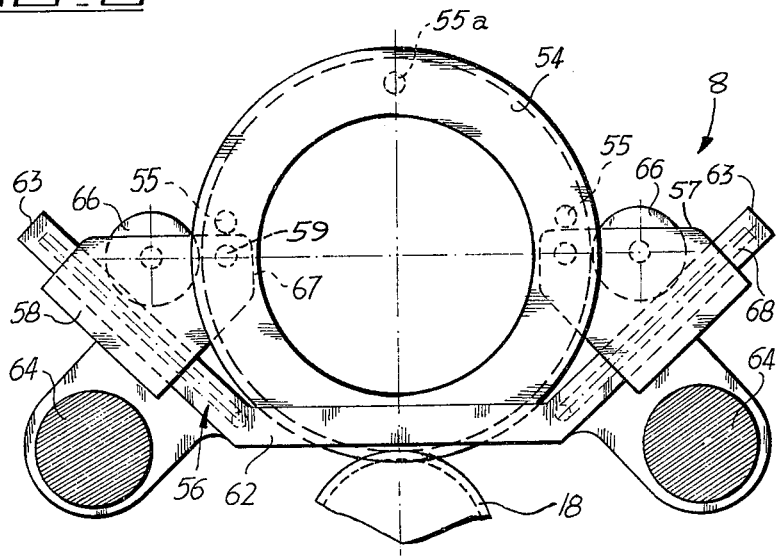
FIG. 5 is an enlarged end view of the printing screen shown in FIG. 1.
Figure 6:
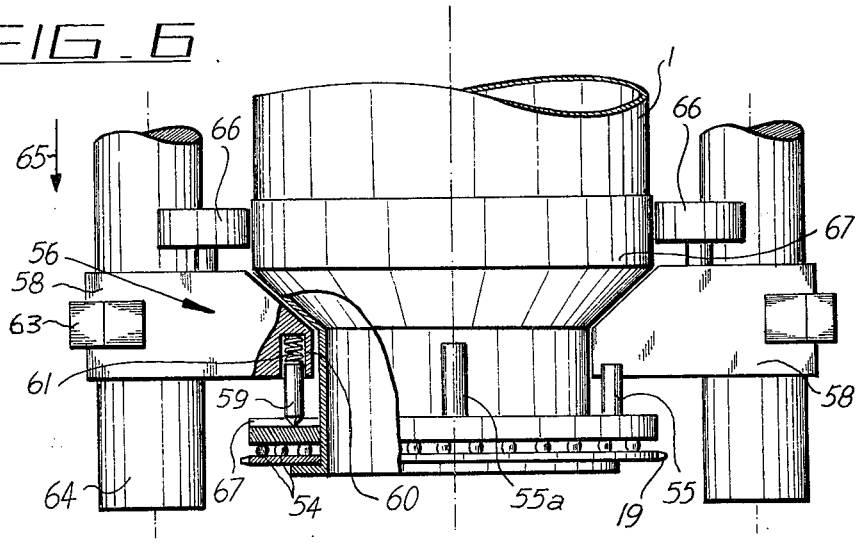
FIG. 6 is a top plan view, with parts broken away, of the assembly shown in FIG. 5.
Figure 7:
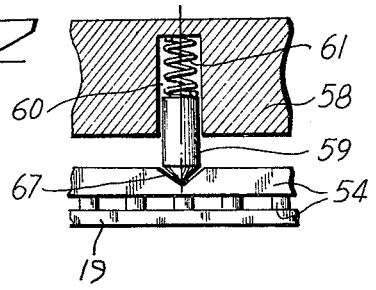
FIG. 7 is a fragmentary sectional view of a detail of the assembly shown in FIGS. 5 and 6.

In FIGS. 5 to 7 I have illustrated a possible construction for the tensioning device 8 associated with the printing screen 1. At each axial end (only one shown) the printing screen 1 is provided with a thrust bearing 54 supporting bolts or pins 55 of a mounting 56. A further pin 55*a* permits the screen 1 to be lifted up when it is to be exchanged for a different screen. As the drawing shows, the screen 1 can be inserted into the mounting unit 56 with pins 55 coming to rest on upper surfaces 57 of a pair of slides 58 which form part of the mounting units 56 and are disposed on opposite sides of the screen. The slides 58 are also provided with tension-transmitting elements or pins 59 which are guided in bores 60 thereof and are urged by springs 61 against the thrust bearing 54. Tensioning of the screen 1 is achieved by moving the entire mounting unit 56, composed of the slides 58 and a bridge 62 with divergent arms 63 carrying these slides, axially outwardly in the direction of an arrow 65 on a pair of guide rods 64. The conical tips of the pins 59 engage in notches 67 of the thrust bearing 54 and further movement in the direction of the arrow 65 represses the pins 59 to be pressed into the respective bores 60 against the force of the springs 61, thus causing them to exert axially directed pressure upon the thrust bearing 54.

It should be understood that the movement of the unit 56 for tensioning purposes amounts only to a few millimeters, just sufficient to cause the pins 59 to engage in the notches 67 and to transmit a certain axial tensile stress to the screen 1 via the springs 61. It will be appreciated that both units 56 (only one shown) or only one may be so adjusted, and that if both are adjusted then of course the other one (i.e. the non-illustrated one) would be moved in the same manner as discussed but opposite to the direction indicated by the arrow 65 in FIG. 6.

Before or during the insertion of the screen 1 into the unit 56, two guide rollers 66 journaled on slides 58 are precisely adjusted to the diameter of the screen 1, or rather of the end portion 67 thereof, so that the screen 1 is properly centered in the respective unit 56. For movement of each slide 58 a leadscrew 68 is operated which is located in the interior of each arm 63 as diagrammatically shown.

The invention is especially suitable for the aforementioned intermittent printing method. With this printing method the screens are brought alternatively into and out of engagement with the substrate, the printing being interrupted temporally by closing the dyestuff applicator. It is just with this printing method that the clearance 36 of the teeth has been found to exert a large influence upon the accuracy of the pattern. Moreover there is the important advantage that the interengagement depth 37 is not reduced by the adjustment of the height of the screen but can be fully utilized with any separation of the screen from the surface of the substrate. The invention might also be used in connection with magnetic roller-type applicators and magnetic beds as for instance shown in my copending application Ser. No. 320,739, filed Jan. 3, 1973, now patent No. 3,890,896.

What I claim is:

1. A rotary-screen printing machine comprising:

a plurality of cylindrical printing screens rotatable about parallel axes lying on a common level;

a machine frame provided with journal bearings for said printing screens;

drive means for rotating said printing screens, said drive means including pinions on said machine frame and gears in mesh with said pinions, said gears being rigid with said printing screens and being coaxially secured to the ends thereof;

a dyestuff applicator within each printing screen;

a plurality of beds each underlying one of said printing screens and forming a flat horizontal surface for supporting a substrate to be imprinted with dyestuff from said applicator; and elevation-adjusting means inserted between said frame and said beds for simultaneously varying the distance of all said beds from said level to compensate for changes in the thickness of the substrate, said elevation-adjusting means including rollers on the undersides of said beds, bases with flat horizontal upper surfaces spacedly confronting said rollers, wedges bearing from below upon said rollers while slidably resting on said upper surfaces, and a horizontally movable link interconnecting said wedges for horizontal displacement on said upper surfaces.

2. A machine as defined in claim 1, further comprising fastening means for immobilizing said link with reference to said frame in a selected position of adjustment.

3. A machine as defined in claim 1, further comprising tensioning devices for axially stressing each of said screens, said tensioning devices including spring-loaded thrust bearings centered on said axes and exerting an axially outward pressure upon said gears.

4. A machine as defined in claim 3 wherein said screens are flanked by axially extending guide rods slidably supporting said tensioning devices.

* * * * *